US009366146B2

(12) United States Patent
Arita et al.

(10) Patent No.: US 9,366,146 B2
(45) Date of Patent: Jun. 14, 2016

(54) CLOSURE BUCKET FOR TURBO-MACHINE

(71) Applicant: General Electric Company, Schenectady, NY (US)

(72) Inventors: Francisco Adelmo Arita, Queretaro (MX); Enrique Diaz, Queretaro (MX); Martin Villegas, Queretaro (MX)

(73) Assignee: General Electric Company, Schenectady, NY (US)

( * ) Notice: Subject to any disclaimer, the term of this patent is extended or adjusted under 35 U.S.C. 154(b) by 515 days.

(21) Appl. No.: 13/915,012

(22) Filed: Jun. 11, 2013

(65) Prior Publication Data

US 2014/0363300 A1 Dec. 11, 2014

(51) Int. Cl.
*F01D 5/32* (2006.01)

(52) U.S. Cl.
CPC ..... *F01D 5/32* (2013.01); *F05D 2250/11* (2013.01); *F05D 2250/121* (2013.01); *F05D 2250/14* (2013.01); *F05D 2250/281* (2013.01)

(58) Field of Classification Search
CPC ..... F01D 5/32; F01D 5/3053; F01D 5/3023; F01D 5/303; F01D 5/3038
See application file for complete search history.

(56) References Cited

U.S. PATENT DOCUMENTS 1,687,891 A * 10/1928 Ray ..... F01D 5/3038 407/107
1,829,881 A * 11/1931 Tucker ..... F01D 5/3038 411/326
2,315,631 A * 4/1943 Lloyd ..... F01D 5/3038 416/216
2,528,305 A * 10/1950 Gubler ..... F01D 5/3038 416/216
2,918,255 A * 12/1959 McGinnis ..... F01D 5/3038 416/216
3,219,314 A * 11/1965 Petrie ..... F01D 5/187 416/193 A
3,873,234 A * 3/1975 Penny ..... F01D 5/021 29/889.21
6,428,279 B1 8/2002 Reluzco et al.
7,229,254 B2 6/2007 Bast et al.
7,901,187 B2 * 3/2011 Barber ..... F01D 5/3038 29/889.1
8,894,372 B2 * 11/2014 Willett, Jr. ..... F01D 5/32 416/220 R
2004/0136831 A1 7/2004 Barb et al.
2013/0164138 A1 * 6/2013 Willett, Jr. ..... F01D 5/32 416/219 R
2013/0330198 A1 * 12/2013 Farineau ..... F01D 5/3038 416/220 R

* cited by examiner

*Primary Examiner* — Richard Edgar
*Assistant Examiner* — Eldon Brockman
(74) *Attorney, Agent, or Firm* — Ernest G. Cusick; Hoffman Warnick LLC

(57) ABSTRACT

A closure bucket for a turbo-machine. In one embodiment, the turbine closure bucket includes a blade section, and a base section positioned adjacent the blade section. The base section of the turbine closure bucket can engage a dovetail slot of a rotor. The base section includes a body having a first end and a second end. The base section also includes an aperture extending through the body of the base section. Additionally, the base section includes an annularly open threaded opening extending along an outer surface of the body. The annularly open threaded opening of the base section is configured to engage a threaded fastener for securing the turbine closure bucket within the dovetail slot of the rotor.

20 Claims, 13 Drawing Sheets

CLOSURE BUCKET FOR TURBO-MACHINE

BACKGROUND OF THE INVENTION

1. Technical Field

The disclosure is related generally to turbo-machines. More specifically, the disclosure is related to closure buckets for turbo-machines.

2. Related Art

Conventional turbo-machines (e.g., gas turbine, steam turbine) are frequently utilized to generate power for electric generators. More specifically, a working fluid such as gas or steam is conventionally forced across sets of turbo-machine blades, which are coupled to the rotor of the turbo-machine. The force of the working fluid on the blades causes those blades (and the coupled body of the rotor) to rotate. In many cases, the rotor body is coupled to the drive shaft of a dynamo-electric machine such as an electric generator. In this sense, initiating rotation of the turbo-machine rotor can initiate rotation of the drive shaft in the electric generator, and cause that generator to generate an electrical current (associated with power output).

The rotor of the turbo-machine typically includes a plurality of stages of buckets (sometimes referred to as blades) positioned in series axially along the rotor. Each stage includes a circumferential arrangement of buckets positioned around the rotor. Each bucket is positioned circumferentially around the rotor by coupling a dovetail portion of the bucket base to a complementary rotor dovetail machined underneath the surface of the rotor. This machined rotor dovetail feature is axisymmetric and is typically segmented, such that the plurality of buckets are positioned within an opening of the complementary rotor dovetail and slidingly positioned within the complementary rotor dovetail until all buckets, except for a closure bucket, are in an operational position. The closure bucket is conventionally positioned to cover a gate opening (e.g., segmented portion) of the complementary rotor dovetail to maintain the remaining buckets in place on the rotor. However, due to the inherent coupling technique used for coupling the closure bucket to the rotor, the closure bucket and the complementary rotor dovetail, including the gate opening, may frequently experience over-stressing during operation of the turbo-machine. As a result of the operational stress, the rotor and components (e.g., buckets, closure bucket) coupled to the rotor may have a reduced operational life and/or may negatively affect the efficiency of the turbo-machine.

BRIEF DESCRIPTION OF THE INVENTION

A closure bucket for a turbo-machine is disclosed. In one embodiment, the closure bucket includes: a blade section; and a base section positioned adjacent the blade section for engaging a dovetail slot of a rotor, the base section including: a body having a first end and a second end; an aperture extending through the body; and an annularly open threaded opening extending along an outer surface of the body.

A first aspect of the invention includes a turbine bucket having: a blade section; and a base section positioned adjacent the blade section for engaging a dovetail slot of a rotor, the base section including: a body having a first end and a second end; an aperture extending through the body; and an annularly open threaded opening extending along an outer surface of the body.

A second aspect of the invention includes a rotor assembly for a turbo-machine. The rotor assembly having: a dovetail slot of a rotor of the turbo-machine; a complementary annularly open threaded opening extending through a portion of a gate opening of the dovetail slot; a turbine bucket positioned within the dovetail slot, the turbine bucket including: a blade section; and a base section positioned adjacent the blade section for engaging the dovetail slot, the base section including: a body having a first end and a second end; an aperture extending through the body; and an annularly open threaded opening extending along an outer surface of the body; and a threaded fastener positioned within the complementary annularly open threaded opening extending through the gate opening of the dovetail slot and the annularly open threaded opening of the turbine bucket for securing the turbine bucket within the gate opening of the dovetail slot.

A third aspect of the invention includes a turbo-machine having: a rotor including a dovetail slot; a turbine bucket including a base section configured to be mounted within the dovetail slot of the rotor, the turbine bucket including: a body having a first end and a second end; an aperture extending through the body; and an annularly open threaded opening extending along an outer surface of the body; a threaded aperture extending into the rotor, the threaded aperture substantially aligned with the annularly open threaded opening extending along the outer surface of the body of the turbine bucket; and a threaded fastener positioned within the annularly open threaded opening of the turbine bucket and the threaded aperture extending into the rotor for securing the turbine bucket within the dovetail slot.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
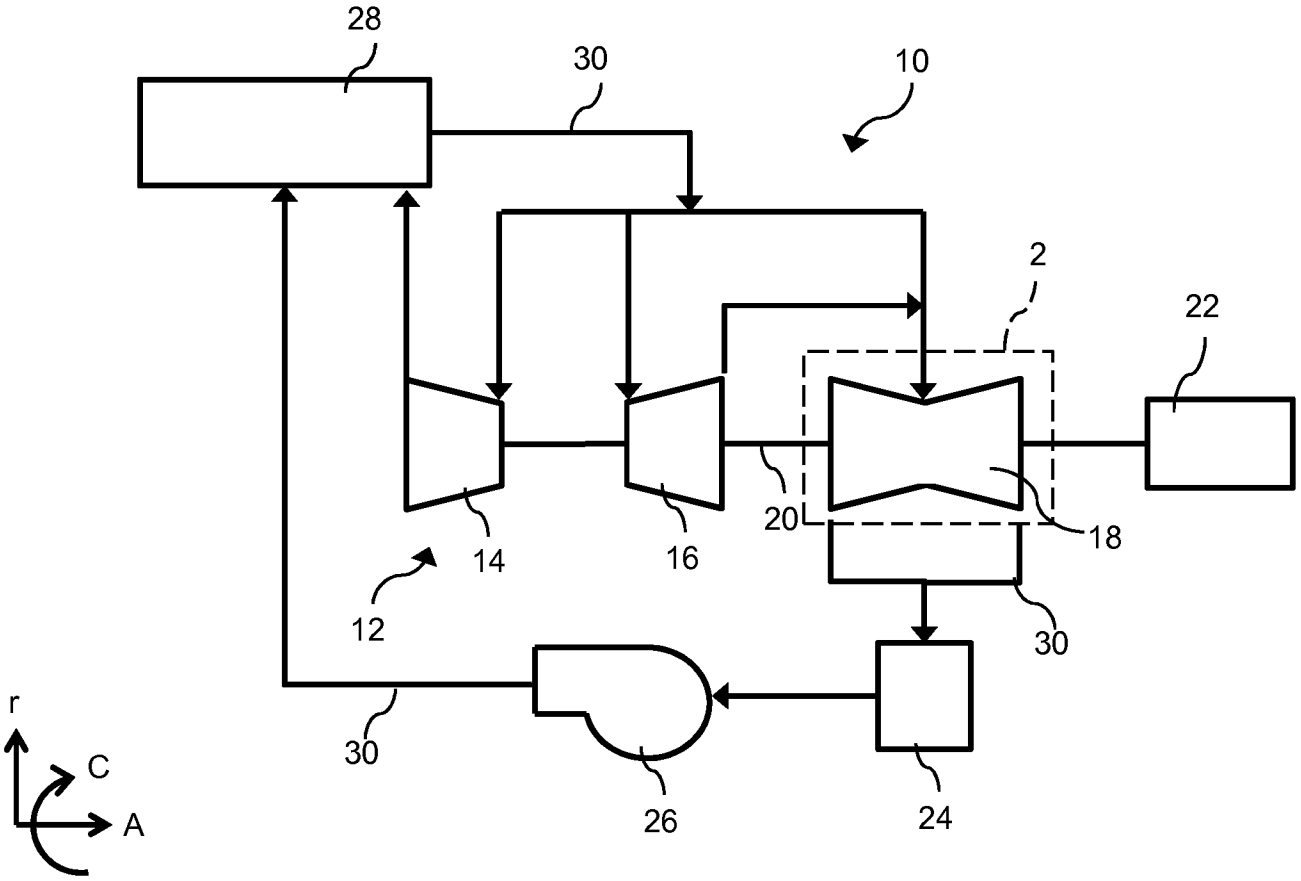
FIG. 1 shows a schematic view of a turbo-machine according to embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As described herein, aspects of the invention relate to a turbo-machine. Specifically, as described herein, aspects of the invention relate to a closure bucket for a turbo-machine.

Turning to FIG. 1, a schematic depiction of a turbo-machine is shown according to embodiments of the invention. Turbo-machine 10, as shown in FIG. 1 may be a conventional steam turbine system. As such, a brief description of the turbo-machine 10 is provided for clarity. As shown in FIG. 1, turbo-machine 10 may include a steam turbine component 12, including a high-pressure section 14, an intermediate-pressure section 16 and a low-pressure section 18, coupled to a rotor 20 of turbo-machine 10. Rotor 20 may also be coupled to a generator 22 for creating electricity during operation of turbo-machine 10. As shown in FIG. 1, turbo-machine 10 may also include a condenser 24 in fluid communication with low-pressure section 18 of steam turbine component 12, a blower 26 in fluid communication with condenser 24 and a heat recovery steam generation (HRSG) 28 in fluid communication with the blower and steam turbine component 12. The components (e.g., condenser 24, blower 26, HRSG 28) of turbo-machine 10 may be in fluid communication with one another via steam conduits 30.

Figure 2:
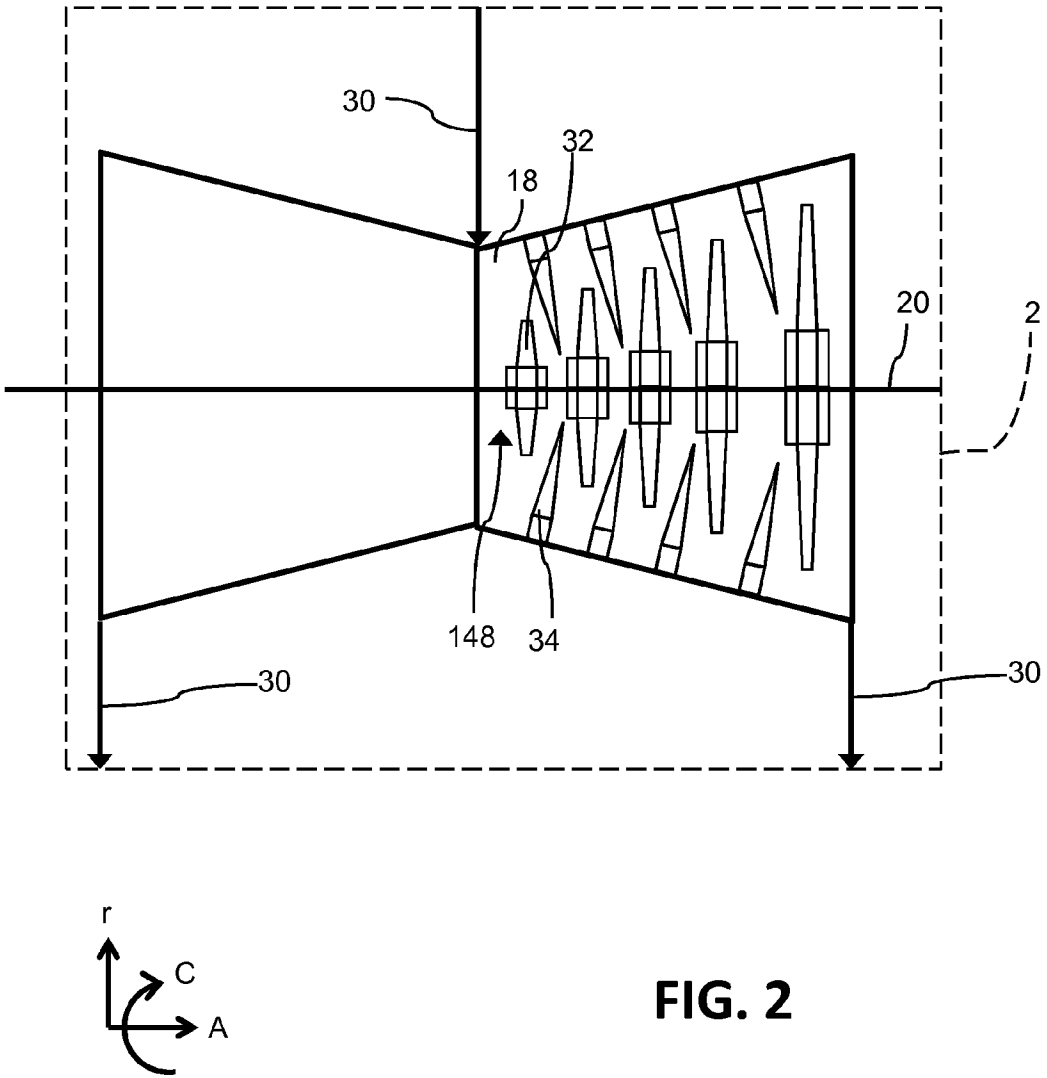
FIG. 2 shows an enlarged schematic view of a portion of the turbine turbo machine in FIG. 1 include the low-pressure section, according to embodiments of the invention.

During operation of turbo-machine 10, as shown in FIG. 1, steam is generated by HRSG 28 and provided to steam turbine component 12. More specifically, HRSG 28 provides steam to high-pressure section 14, intermediate-pressure section 16 and low-pressure section 18 via conduits 30 to flow through steam turbine component 12. Each section (e.g., low-pressure section 18) of steam turbine component 12 may include a plurality of stages of buckets 32 (FIG. 2) positioned in series on rotor 20, and a plurality of stator vanes 34 (FIG. 2) positioned adjacent the plurality of buckets 32. More specifically, each of the plurality of buckets 32 for each stage may extend circumferentially around rotor 20. As steam flows over each stage of buckets 32 (FIG. 2), rotor 20 may be rotated and generator 22 may create power (e.g., electric current). The plurality of stator vanes 34 may aid in directing the steam toward the plurality of stages of buckets 32 (FIG. 2) during operation of turbo-machine 10. The steam may exit steam turbine component 12, specifically low-pressure section 18, and may be condensed by condenser 24 and provided to HRSG 28 via blower 26. The steam may then aid in the generation of more steam by HRSG 28 and may be provided to steam turbine component 12 again.

As used herein, the terms "axial" and/or "axially" refer to the relative position/direction of objects along axis A, which is substantially parallel with the axis of rotation of turbo-machine 10 (in particular, the rotor section). As further used herein, the terms "radial" and/or "radially" refer to the relative position/direction of objects along axis (r), which is substantially perpendicular with axis A and intersects axis A at only one location. Additionally, the terms "circumferential" and/or "circumferentially" refer to the relative position/direction of objects along a circumference which surrounds axis A but does not intersect the axis A at any location.

Figure 3:
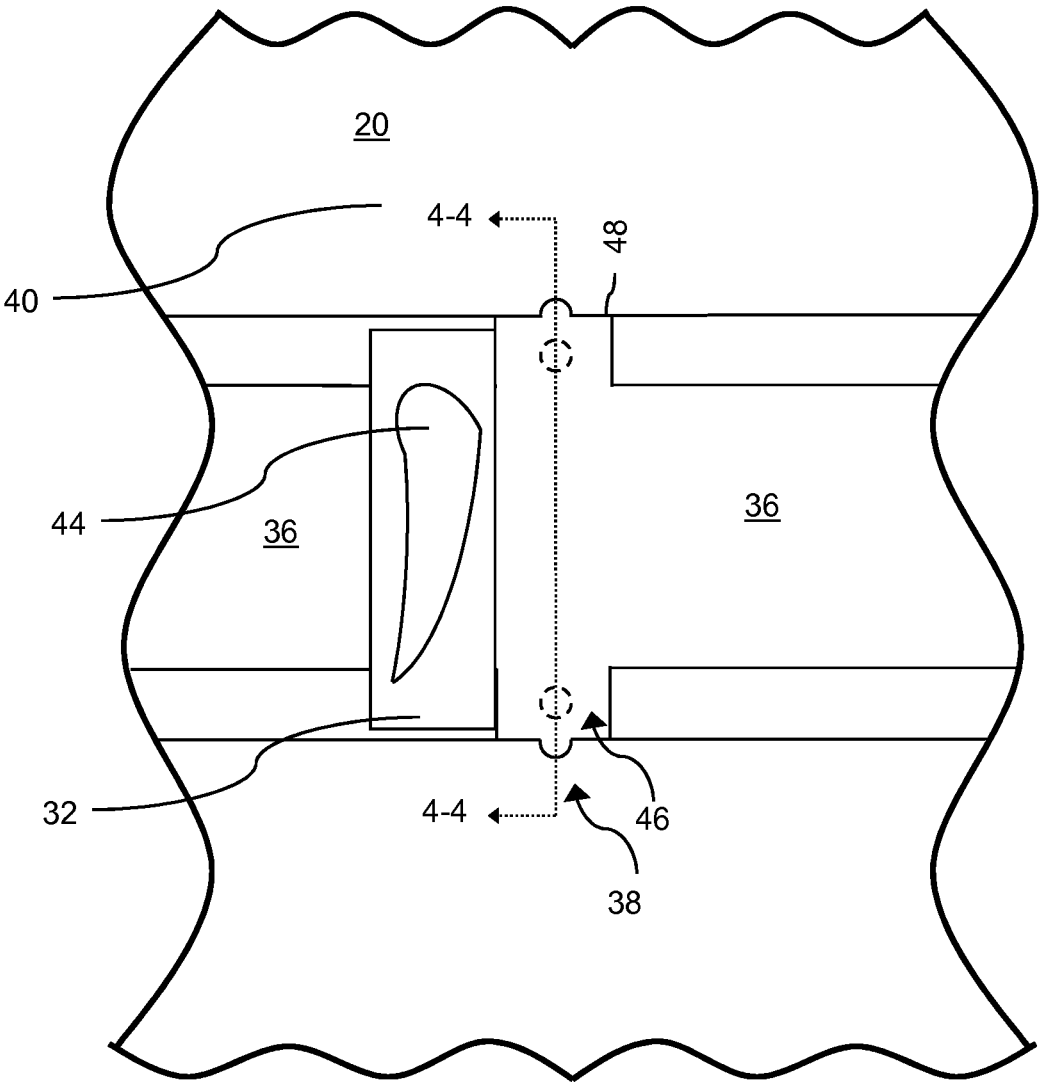
FIG. 3 shows a top view of a portion of a rotor including a turbine bucket positioned within a dovetail slot, according to embodiments of the invention.
Figure 4:
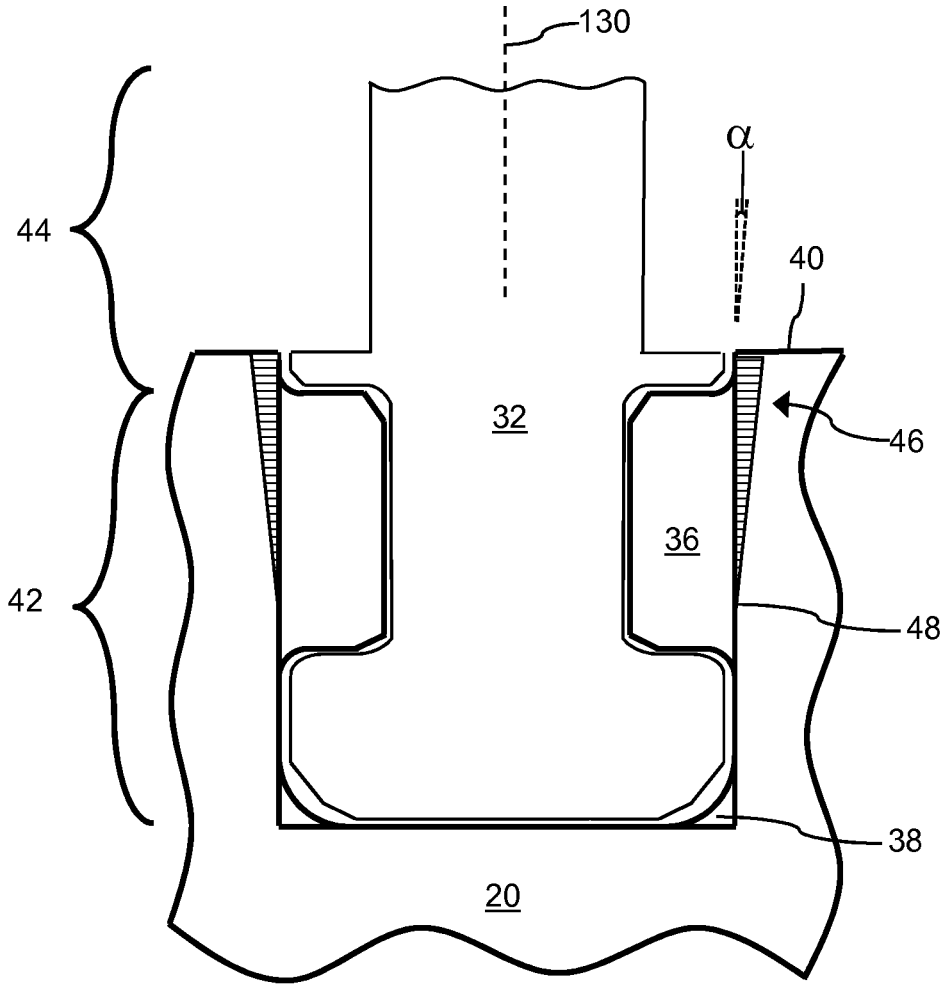
FIG. 4 shows a cross-sectional view along line 4-4 of FIG. 3, the cross-section view showing a portion of a rotor of a turbo-machine including a turbine bucket positioned within a dovetail slot, according to various embodiments of the invention.
Figure 4:
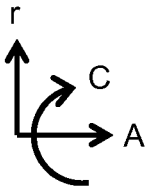

Turning to FIGS. 3 and 4, each of the plurality of turbine bucket 32 in each stage of steam turbine component 12 (FIG. 1) may be positioned within a dovetail slot 36 of rotor 20. As shown in FIG. 3, dovetail slot 36 may include gate opening 38 to allow a plurality of turbine buckets 32 to be slidingly positioned within dovetail slot 36. That is, each of the plurality of buckets 32 may be positioned within gate opening 38 and subsequently slidingly positioned within dovetail slot 36 to couple turbine buckets 32 to rotor 20. Once slidingly positioned within dovetail slot 36, the plurality of turbine buckets 32 may be disposed circumferentially (C) around rotor 20. As shown in FIGS. 3 and 4, dovetail slot 36 may be formed directly within a surface 40 of rotor 20, and may be oriented to engage a base 42 of turbine buckets 32. More specifically, dovetail slot 36 may include a complementary shape to base 42 of turbine buckets 32, such that dovetail 36 may receive and engage base 42 of turbine buckets 32 during the operation of turbo-machine 10 (FIG. 1). As shown in FIG. 4, blade 44, adjacent base 42 of turbine bucket 32, may be positioned substantially outside of dovetail slot 36. More specifically, blade 44 of turbine bucket 32 may be positioned substantially outside of dovetail slot 36 and may be positioned adjacent surface 40 of rotor 20.

Figure 5:
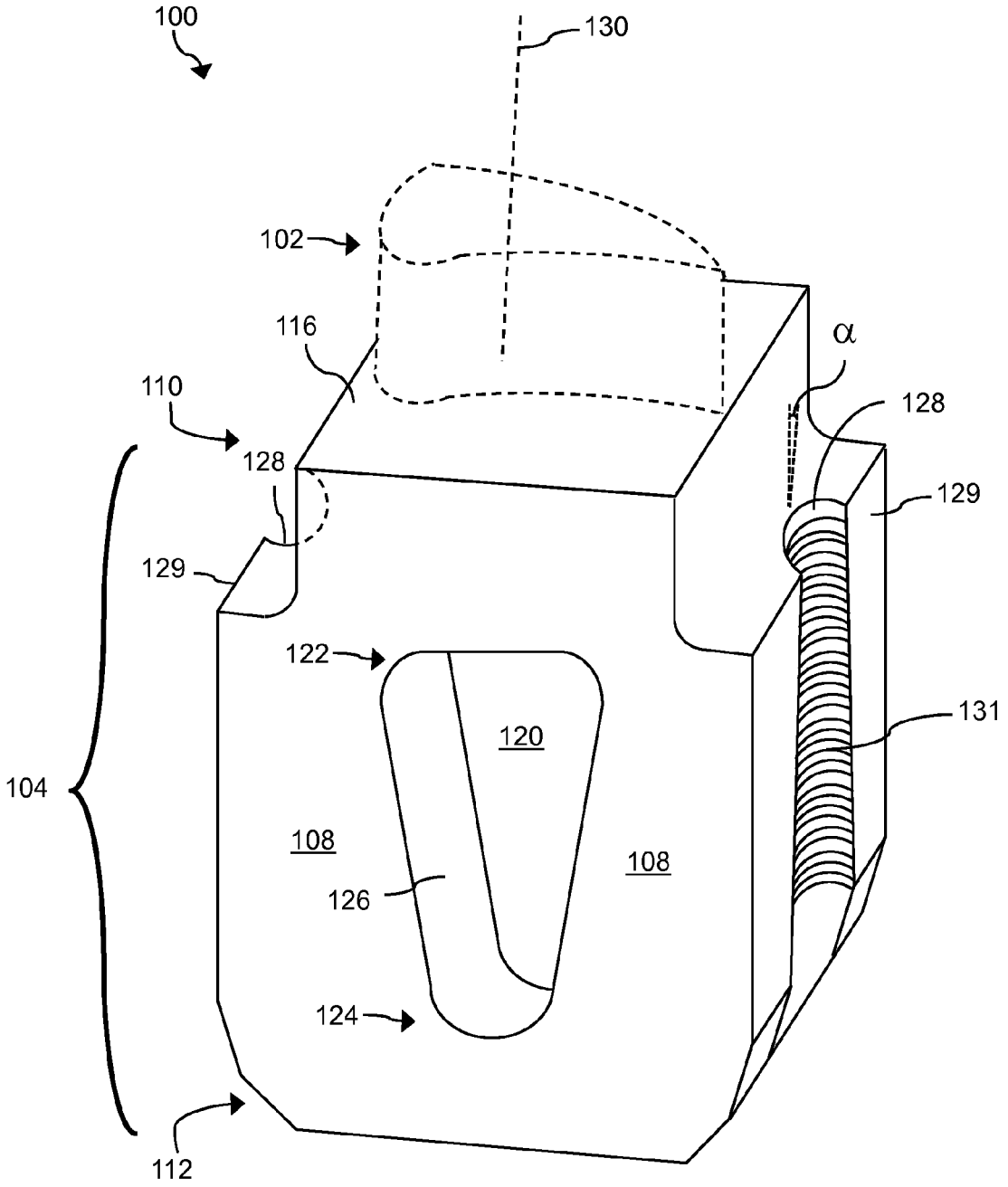
FIG. 5 shows a schematic cut-away perspective view of a closure bucket according to embodiments of the invention.

Turning to FIG. 5, a schematic cut-away perspective view of a closure bucket is shown according to embodiments of the invention. In various embodiments, as shown in FIG. 5, closure bucket 100 may include a blade section 102, and a base section 104 positioned adjacent blade section 102. Base section 104 of closure bucket 100 may engage gate opening 38 in dovetail slot 36 of rotor 20 (FIG. 3) for substantially securing closure bucket 100 within rotor 20 (FIG. 3), as described herein. As shown in FIG. 5, base section 104 may include a body 108 having a first end 110 and a second end 112 opposite first end 110. In an embodiment, as shown in FIG. 5, blade support 116 may be positioned between first end 110 of body 108 of base portion 104 and blade section 102. More specifically, first end 110 of body 108 may include a blade support 116 of closure bucket 100. Blade support 116 may provide support to blade section 102 of closure bucket 100. That is, as shown in FIG. 5, blade support 116 may act as a platform for providing support for blade section 102 during operation of a turbo-machine utilizing closure bucket 100.

In various embodiments, as shown in FIG. 5, base section 104 may also include an aperture 120 extending through body 108 of base section 104. In an embodiment, as shown in FIG. 5, aperture 120 may extend circumferentially (C) through body 108 of base section 104. That is, aperture 120 may extend entirely through body 108 of base section 104 in a circumferential direction (C) of rotation of closure bucket 100 during operation of a turbo-machine 10 (FIG. 1). As shown in FIG. 5, aperture 120 may include a first portion 122 positioned adjacent first end 110 of body 108, and a second portion 124, opposite first portion 122, positioned adjacent second end 112 of body 108. As shown in FIG. 5, second portion 124 of aperture 120 may be smaller in width than first portion 122 of aperture 120. As such, aperture 120 may also include a set of tapered side walls 126 extending from first portion 122 of aperture 120 positioned adjacent first end 110 of body 108 to second portion 124 of aperture 120 positioned adjacent second end 112 of body 108. That is, aperture 120 of closure bucket 100 may be substantially trapezoidal in shape. Aperture 120 may be formed in base section 104, and specifically body 108, of closure bucket 100 by any conventional material removal process, for reducing the total weight of closure bucket 100.

Also shown in FIG. 5, base section 104 of closure bucket 100 may also include annularly open threaded openings (AOTO) 128 extending along an outer surface 129 of body 108. More specifically, as shown in FIG. 5, base section 104 may include at least two annularly open threaded openings (AOTO) 128 extending along outer surface 129 of body 108. In an embodiment, as shown in FIG. 5, the at least two AOTO 128 may be positioned opposite one another with respect to body 108 of base section 104. AOTO 128 may be annularly open, such that AOTO 128 may be a substantially semi-circular shaped opening formed on outer surface 129 of body 108. More specifically, AOTO 128 may be a substantially C-shaped opening form on outer surface 129 of body 108. Also shown in FIG. 5, AOTO 128 may angularly extend along outer surface 129 of body 108. In an embodiment, AOTO 128 may angularly extend along outer surface 129 of body 108 at an angle (α) between approximately five (5) degrees and approximately ten (10) degrees from a longitudinal axis 130 of closure bucket 100. AOTO 128 may include threads 131 for substantially engaging a threaded fastener 132 (FIGS. 7-10), as discussed herein.

Figure 6:
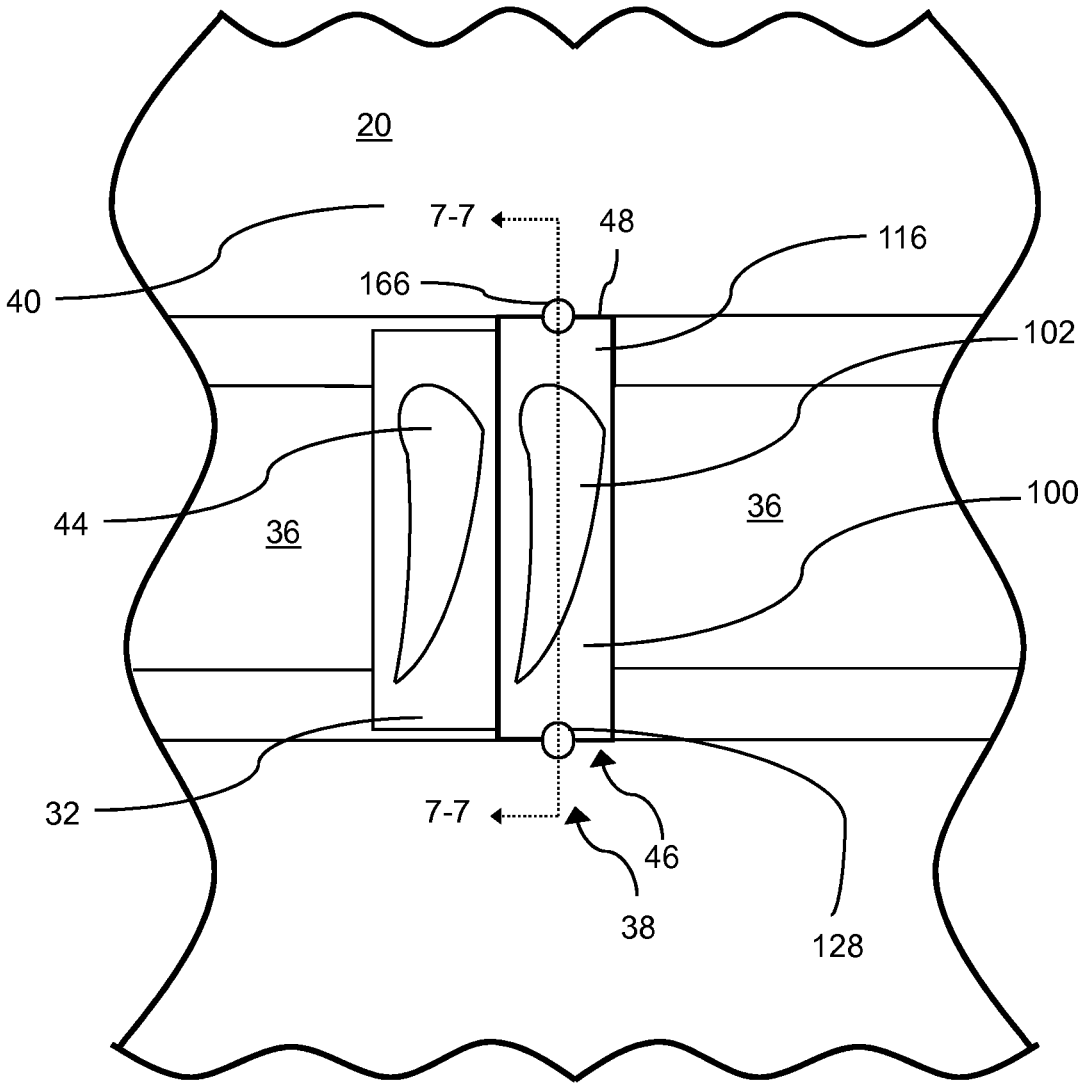
FIG. 6 shows a top view of a portion of a rotor including a turbine bucket positioned within a dovetail slot and a closure bucket positioned within a gate opening, according to embodiments of the invention.
Figure 7:
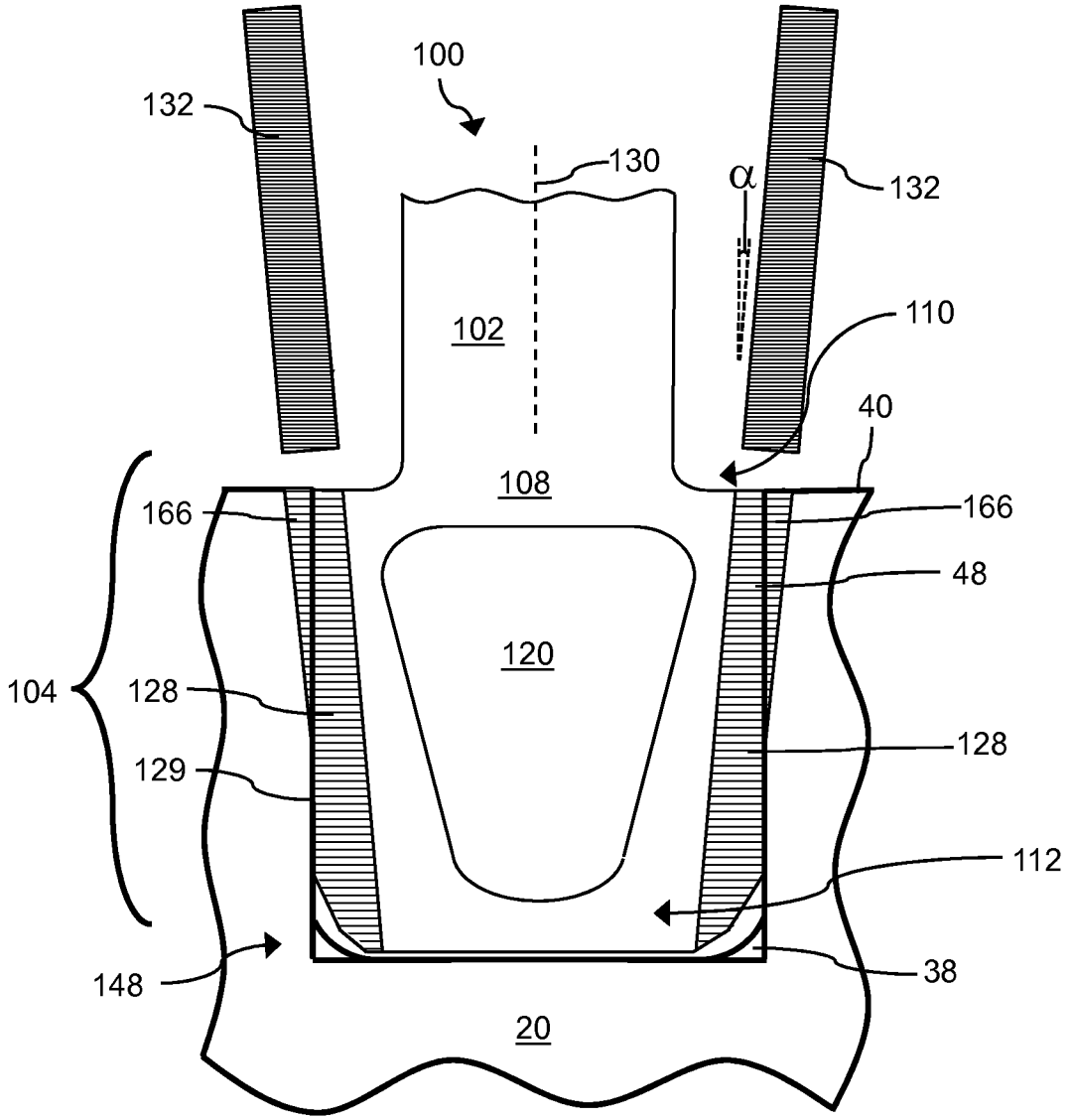
FIG. 7 shows a cross-sectional view along line 7-7 of FIG. 6, the cross-section view showing a portion of a rotor of a turbo-machine including a closure bucket positioned within a gate opening, according to various embodiments of the invention.
Figure 7:
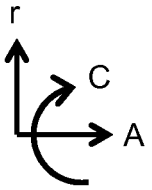

Turning to FIGS. 6 and 7, closure bucket 100 may be positioned within gate opening 38 in dovetail slot 36 of rotor 20. More specifically, closure bucket 100 may be positioned within and may engage gate opening 38 in dovetail slot 36 for preventing the plurality of buckets 32 from becoming unengaged with dovetail slot 36 of rotor 20 during operation of turbo-machine 10 (FIG. 1). That is, as shown in FIG. 6, closure bucket 100 may be positioned adjacent to the plurality of turbine buckets 32, and may substantially prevent the plurality of buckets 32 from being removed from rotor 20 of steam turbine component 12.

Turning to FIG. 7, a cross-sectional view of a portion of rotor 20 of turbo-machine 10 (FIG. 1) is shown including closure bucket 100 positioned within gate opening 38, according to various embodiments of the invention. As shown in FIG. 7, and previously discussed with reference to FIGS. 5 and 6, rotor assembly 148 may couple closure bucket 100 and the plurality of buckets 32 to rotor 20 of turbo-machine 10 (FIG. 1). As shown in FIG. 7, rotor assembly 148 may include dovetail slot 36 of rotor 20 of turbo-machine 10 (FIG. 1). As shown in FIG. 7, and as previously discussed, dovetail slot 36 may include a gate opening 38 for engaging base section 104 of closure bucket 100.

In various embodiments, as shown in FIG. 7, gate opening 38 of dovetail slot 36 of rotor assembly 148 may include a complementary annularly open threaded opening (CAOTO) 166 extending through a portion 46 of gate opening 38 of dovetail slot 36. More specifically, as shown in FIG. 7, gate opening 38 of dovetail slot 36 may include two complementary annularly open threaded opening (CAOTO) 166 extending through a side wall 48 of gate opening 38 of dovetail slot 36, adjacent each of the AOTO 128 of base section 104 of closure bucket 100. Briefly returning to FIGS. 3 and 6, and with reference to FIG. 7, CAOTO 166 may be annularly open, such that CAOTO 166 may be a semi-circular opening formed on portion 46 of gate opening 38 that may mirror the semi-circular opening forming AOTO 128 (FIG. 5). As shown in FIGS. 6 and 7, CAOTO 166 may be substantially aligned with AOTO 128 extending along outer surface 129 of body 108 of closure bucket 100. That is, CAOTO 166 of gate opening 38 and AOTO 128 of closure bucket 100 may be substantially aligned such that when closure bucket 100 is positioned within gate opening 38 of dovetail slot 36, CAOTO 166 and AOTO 128 may form an annular threaded aperture configured to engage threaded fastener 132.

Figure 8:
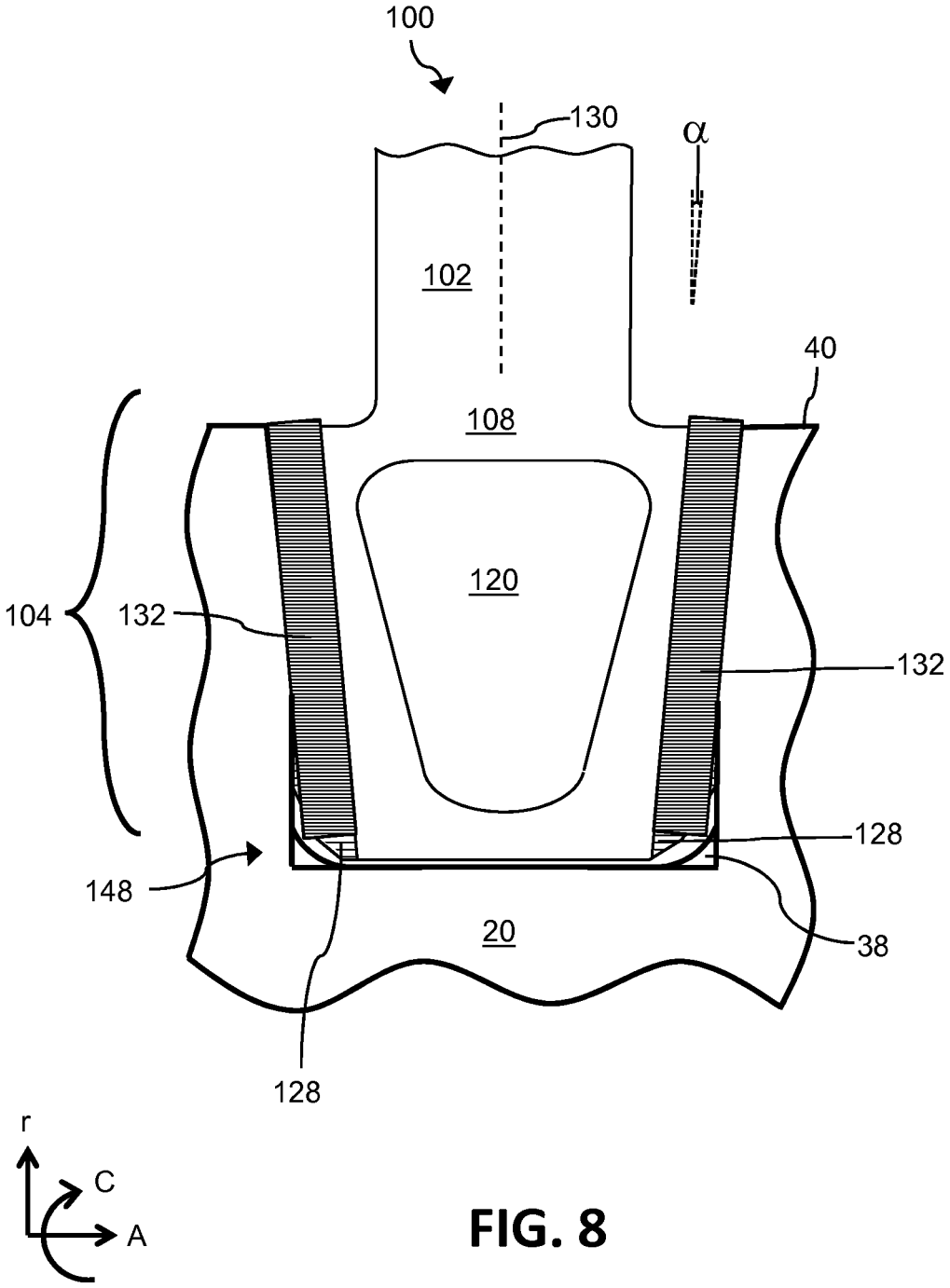
FIGS. 8-10 show a cross-sectional view of a portion of a rotor of a turbo-machine including a closure bucket positioned within a gate opening, according to various embodiments of the invention.

In an embodiment, as shown in FIG. 7, CAOTO 166 may also angularly extend through the portion 46 of gate opening 38 of dovetail slot 36. More specifically, CAOTO 166 may angularly extend through the portion 46 of gate opening 38 of dovetail slot 36 at an angle (α) between approximately five (5) degrees and approximately ten (10) degrees from longitudinal axis 130 of closure bucket 100. As such, the threaded openings (e.g., AOTO 128, CAOTO 166) may provide a connection passageway for threaded fastener 132 for securing closure bucket 100 within gate opening 38 of dovetail slot 36 of rotor assembly 148. More specifically, as shown in FIG. 8, threaded fastener 132 may be positioned within AOTO 128 and CAOTO 166, respectively, to engage the respective threads of each opening (e.g., AOTO 128, CAOTO 166) for securing closure bucket 100 within gate opening 38 of dovetail slot 36 during operation of turbo-machine 10 (FIG. 1).

Figure 9:
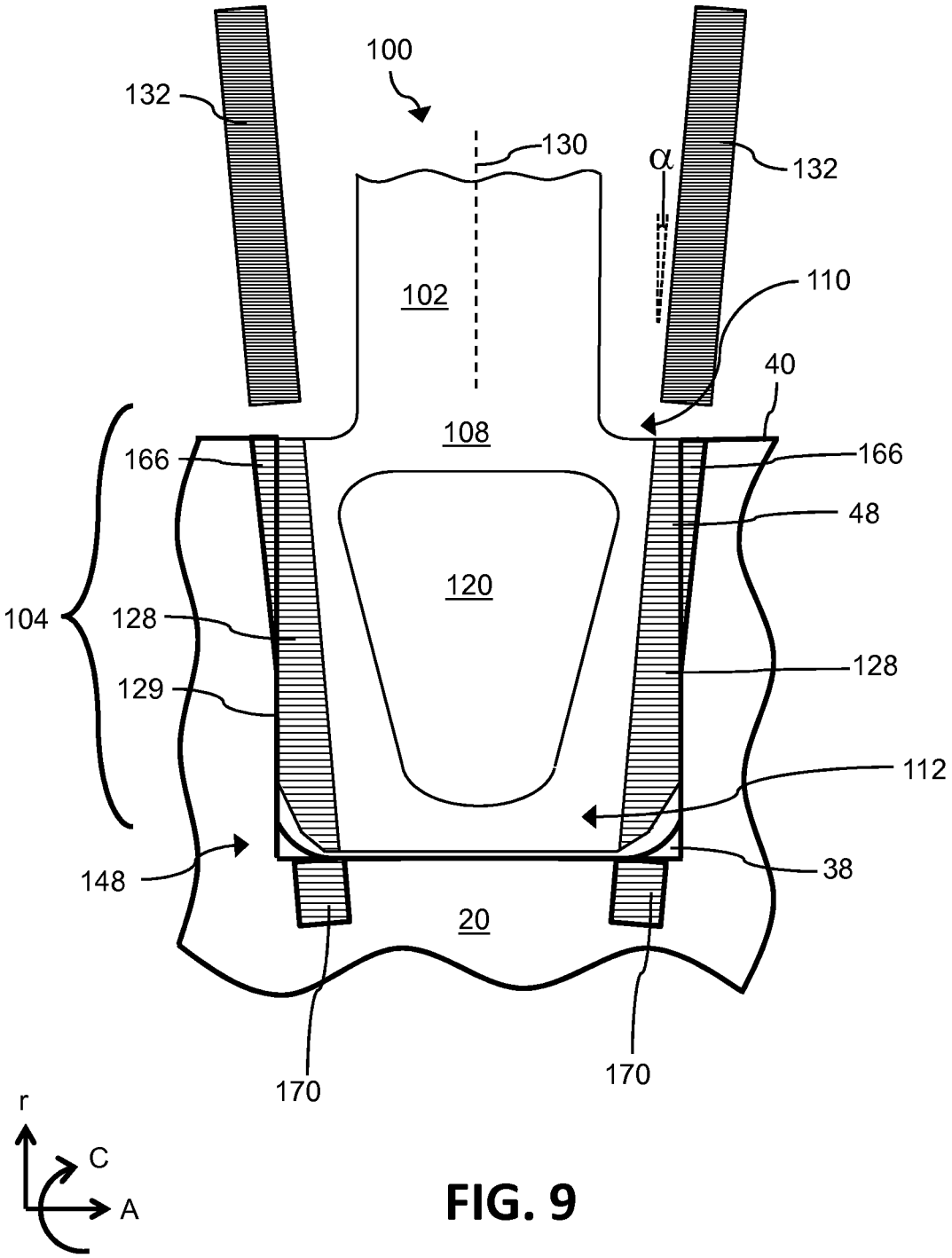
Figure 10:
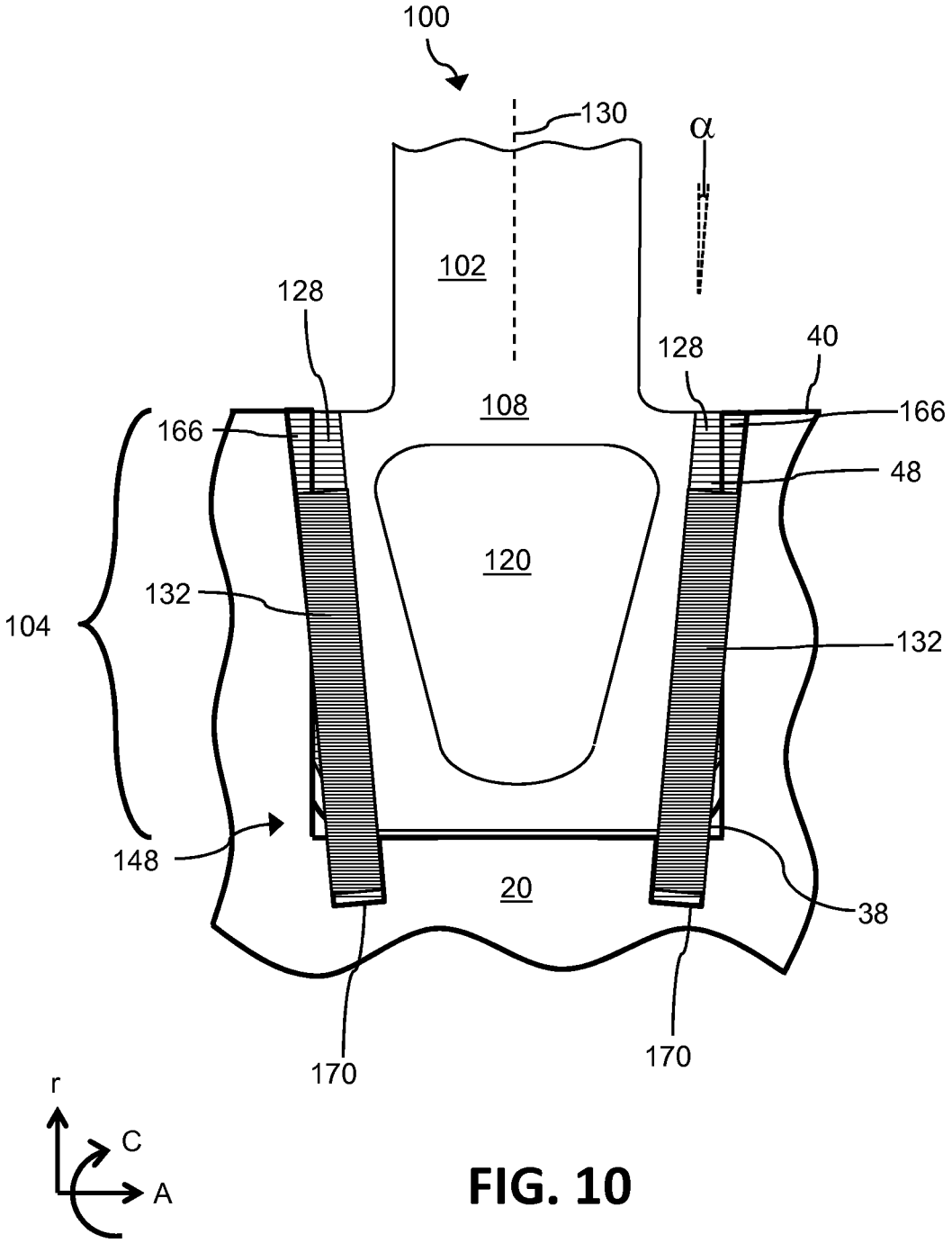

In some cases, as shown in FIG. 9, dovetail slot 36 of rotor assembly 148 may also include a threaded aperture 170 extending into rotor 20. More specifically, threaded aperture 170 may extend partially through rotor 20 within gate opening 38 of dovetail slot 36. In an embodiment as shown in FIG. 9, threaded aperture 170 may also be positioned adjacent second end 112 of body 108 of closure bucket 100. As shown in FIG. 9, AOTO 128, CAOTO 166 and threaded aperture 170 may be in substantial alignment (e.g., angularly extending), and may be configured to engage threaded fastener 132 for securing closure bucket 100 within gate opening 38 of dovetail slot 36. More specifically, as shown in FIG. 9, threaded aperture 170 may engage an end of threaded fastener 132 that may pass along outer surface 129 of body 108 of closure bucket 100, and may provide additional support for securing closure bucket 100 with mounting slot 106. As discussed herein with respect to AOTO 128 of closure bucket 100, threaded aperture 170 may extend into rotor 20 at an angle (α) between approximately five (5) degrees and approximately ten (10) degrees from longitudinal axis 130 of closure bucket 100.

Figure 11:
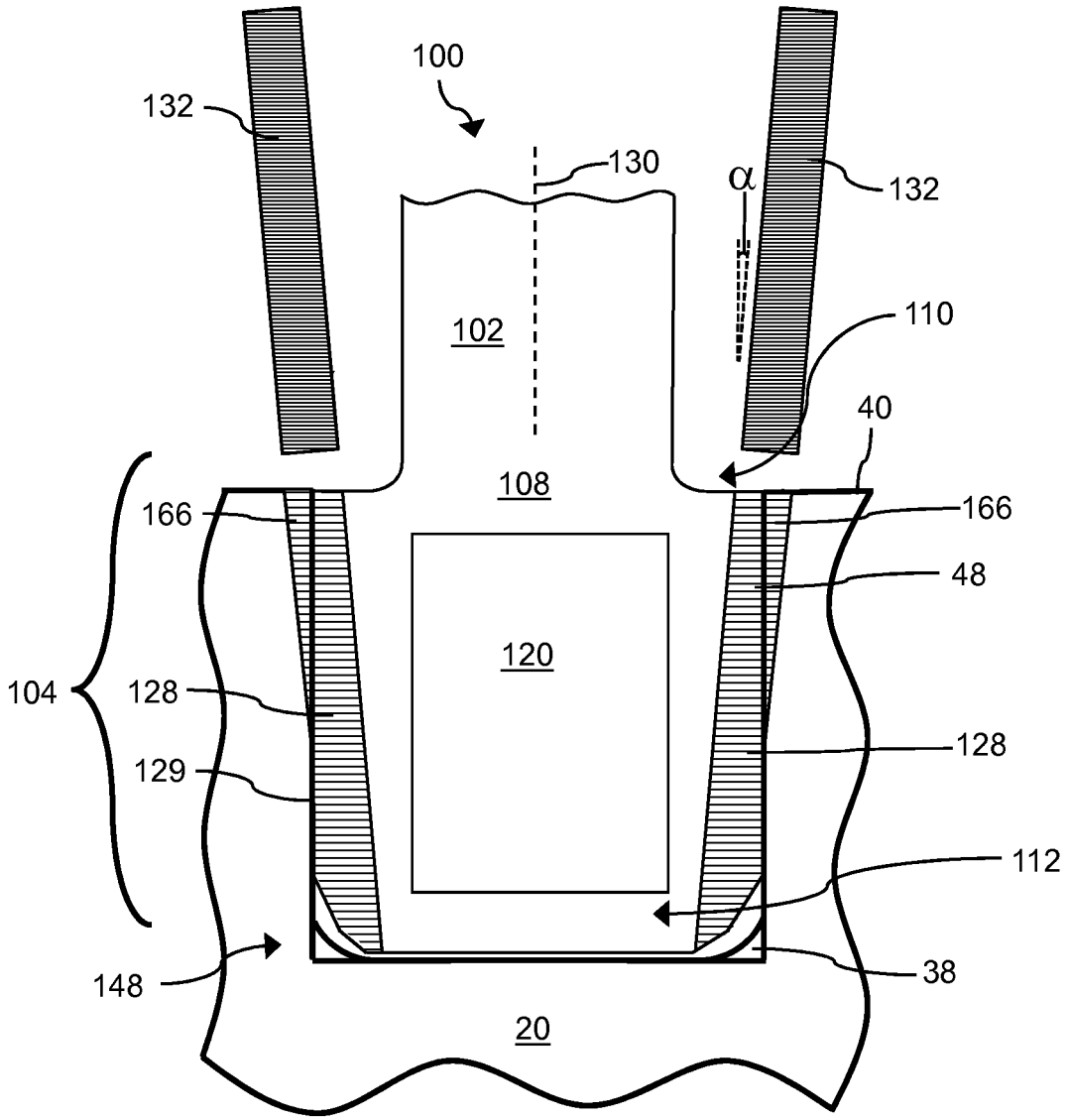
FIGS. 11-13 show a cross-sectional view of a closure bucket, according to alternative embodiments of the invention.
Figure 11:
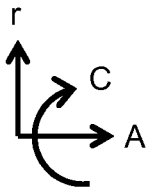
Figure 12:
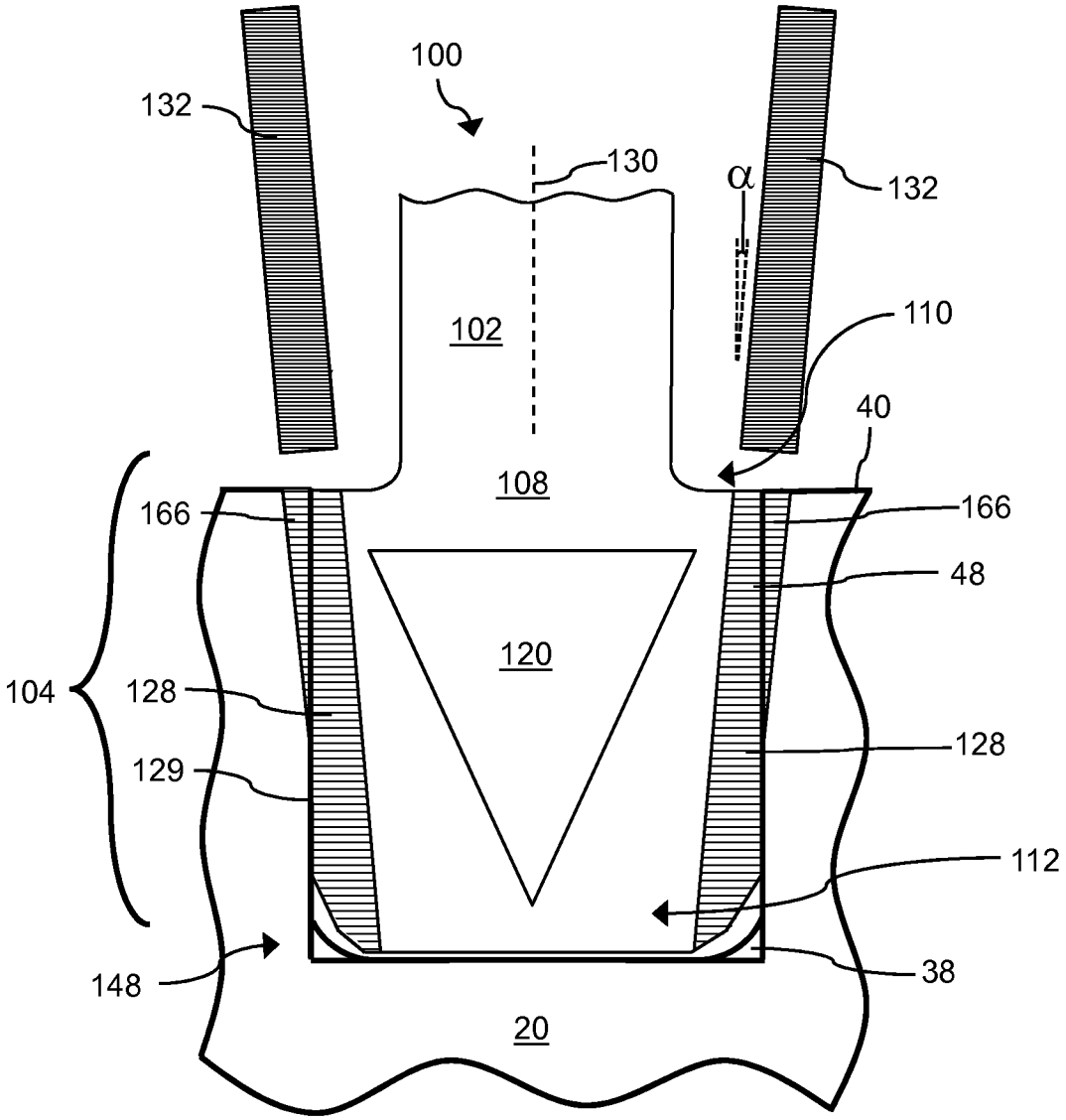
Figure 12:
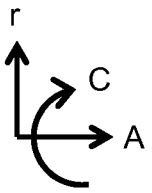
Figure 13:
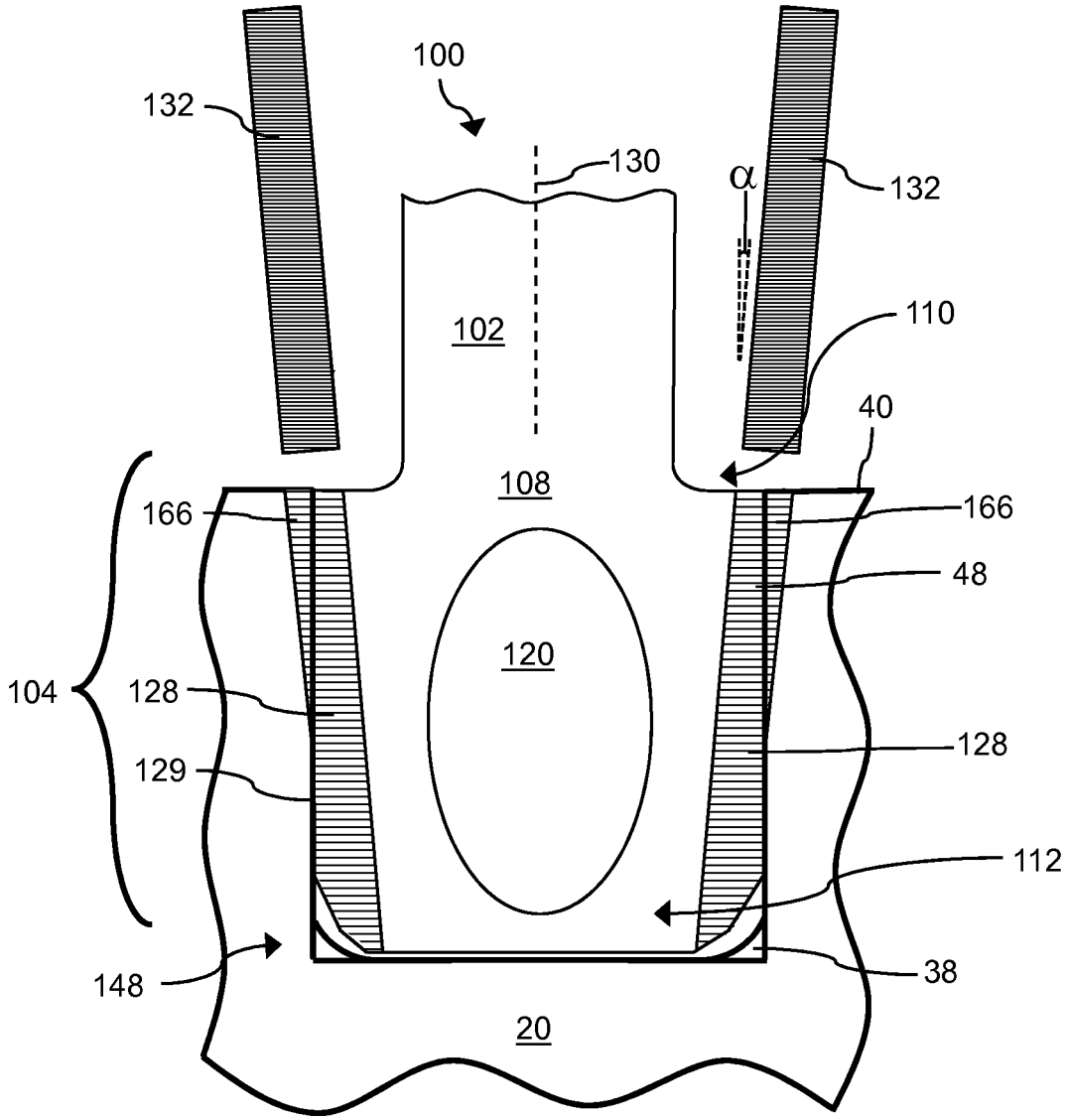
Figure 13:
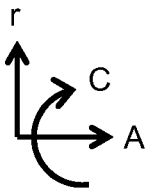

Turning to FIGS. 11-13, a cross-sectional view of closure bucket 100 is shown, according to alternative embodiments of the invention. As shown in FIG. 11, aperture 120 of closure bucket 100 may be substantially polygonal. More specifically, as shown in FIG. 11 aperture 120 of closure bucket 100 may be oriented as a substantially rectangular aperture (e.g., aperture 120) extending circumferentially (C) through base section 104 of closure bucket 100. In an alternative embodiment, as shown in FIG. 12, aperture 120 may be oriented as a substantially triangular aperture (e.g., aperture 120) extending circumferentially (C) through base section 104 of closure bucket 100. Further, as shown in FIG. 13, aperture 120 may be oriented as a substantially circular aperture (e.g., aperture 120) extending circumferentially (C) through base section 104 of closure bucket 100. It is understood, that aperture 120 of closure bucket 100 may be oriented as any shape that may substantially reduce the weight of closure bucket 100 to be used with turbo-machine 10 (FIG. 1).

Although described herein as turbo-machine 134 being any conventional steam turbine, which may utilize closure bucket 100, it is understood that a gas turbine system may also utilize closure bucket 100. More specifically, in an alternative embodiment (not shown), a turbine component of a gas turbine system may utilize closure bucket 100 in at least one of the plurality of stages of buckets or blades within the turbine component.

By utilizing the closure bucket 100, as discussed herein, turbo-machine 10 may substantially reduce the risk of decreased efficiency caused by rotor imbalance. More specifically, as a result of utilizing closure bucket 100 including an aperture 120, closure bucket 100 may be substantially light-weight, and may allow rotor 20 to rotate with a substantially even weight distribution of the buckets (e.g., plurality of buckets 32, closure bucket 100) positioned circumferentially around rotor 20 of turbo-machine 10. As such, rotor 20 may rotate in a substantially uniform manner without substantial deviation from a desired rotational path. In addition, by minimizing the potential for rotor imbalance and utilizing closure bucket 100 within turbo-machine 10, closure bucket 100 and the plurality of buckets 32 may be substantially maintained in place during operation of turbo-machine 10. This may ultimately result in reducing the likelihood of closure bucket 100 and/or the plurality of buckets 32 from becoming uncoupled to dovetail slot 36 and/or rotor 20 during operation of turbo-machine 10.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbine bucket comprising:

a blade section; and a base section positioned adjacent the blade section for engaging a gate opening in a dovetail slot of a rotor, the rotor including a threaded aperture extending radially inward from an interior surface of the dovetail slot, wherein the base section includes:

a body having a first end and a second end;

an aperture extending through the body; and an annularly open threaded opening extending along an outer surface of the body, wherein the annularly open threaded opening is substantially aligned with the threaded aperture of the dovetail slot, such that a threaded fastener engaging the annularly open threaded opening extends radially into the threaded aperture.

2. The turbine bucket of claim 1, further comprising a blade support positioned between the first end of the body of the base section and the blade section.

3. The turbine bucket of claim 1, wherein the second end of the body is positioned adjacent a bottom portion of the dovetail slot of the rotor.

4. The turbine bucket of claim 1, wherein the dovetail slot of the rotor further includes a complementary annularly open threaded opening extending through a portion of the gate opening of the dovetail slot of the rotor, the complementary annularly open threaded opening substantially aligned with the annularly open threaded opening extending along the outer surface of the body of the base section.

5. The turbine bucket of claim 4, wherein the annularly open threaded opening of the base section and the complementary annularly open threaded opening extending through a portion of the gate opening are configured to engage a threaded fastener for securing the turbine bucket within the gate opening of the dovetail slot of the rotor.

6. The turbine bucket of claim 1, wherein the annularly open threaded opening of the base section angularly extends along the outer surface of the body.

7. The turbine bucket of claim 1, wherein the aperture extends circumferentially through the body of the base section.

8. The turbine bucket of claim 1, wherein the aperture extending through the body of the base section includes:

a first portion positioned adjacent the first end of the body; and a second portion positioned adjacent the second end of the body, wherein the second portion is smaller in width than the first portion.

9. The turbine bucket of claim 8, wherein the aperture extending through the body of the base section includes a set of tapered side walls extending from the first portion of the opening positioned adjacent the first end of the body to the second portion of the opening positioned adjacent the second end of the body.

10. The turbine bucket of claim 1, wherein the base section includes at least two annularly open threaded openings extending along the outer surface of the body opposite one another.

11. A rotor assembly for a turbo-machine, the rotor assembly comprising:

a dovetail slot of a rotor of the turbo-machine, wherein the dovetail slot includes a threaded aperture extending radially into the rotor;

a complementary annularly open threaded opening extending through a portion of a gate opening of the dovetail slot;

a turbine bucket positioned within the gate opening of the dovetail slot, the turbine bucket including:

a blade section; and a base section positioned adjacent the blade section for engaging the gate opening, the base section including:

a body having a first end and a second end;

an aperture extending through the body; and an annularly open threaded opening extending along an outer surface of the body, wherein the annularly open threaded opening is substantially aligned with the threaded aperture of the dovetail slot; and a threaded fastener positioned within the complementary annularly open threaded opening extending radially through the gate opening of the dovetail slot and the annularly open threaded opening of the turbine bucket into the threaded aperture within the rotor, such that the threaded fastener secures the turbine bucket within the gate opening of the dovetail slot.

12. The rotor assembly of claim 11, wherein the turbine bucket includes a blade support positioned between the first end of the body of the base section and the blade section.

13. The rotor assembly of claim 11, wherein the second end of the body of the turbine bucket is positioned adjacent a bottom portion of the dovetail slot.

14. The rotor assembly of claim 11, wherein the complementary annularly open threaded opening angularly extends through the portion of the gate opening of the dovetail slot, and the annularly open threaded opening of the turbine bucket angularly extends along the outer surface of the body of the base section.

15. The rotor assembly of claim 11, wherein the aperture of the turbine bucket extends circumferentially through the body of the base section.

16. The rotor assembly of claim 11, wherein the aperture of the turbine bucket extending through the body of the base section includes:

a first portion positioned adjacent the first end of the body of the turbine bucket; and a second portion positioned adjacent the second end of the body of the turbine bucket, wherein the second portion is smaller in width than the first end.

17. The rotor assembly of claim 11, wherein the turbine bucket includes at least two annularly open threaded openings extending along the outer surface of the body of the base section, opposite one another.

18. A turbo-machine comprising:

a rotor including a dovetail slot, wherein the dovetail slot includes a threaded aperture extending radially into the rotor;

a turbine bucket including a base section configured to be mounted within a gate opening in the dovetail slot of the rotor, the turbine bucket including:

a body having a first end and a second end;

an aperture extending through the body; and an annularly open threaded opening extending along an outer surface of the body, wherein the annularly open threaded opening is substantially aligned with the threaded aperture of the dovetail slot;

a threaded aperture extending radially into the rotor, the threaded aperture substantially aligned with the annularly open threaded opening extending along the outer surface of the body of the turbine bucket; and a threaded fastener positioned within the annularly open threaded opening of the turbine bucket and the threaded aperture extending radially into the threaded aperture of the rotor, such that the threaded fastener secures the turbine bucket within the dovetail slot.

19. The turbo-machine of claim 18, wherein the dovetail slot of the rotor further includes a complementary annularly open threaded opening extending through a portion of a gate opening of the dovetail slot, the complementary annularly open threaded opening substantially aligned with the annularly open threaded opening extending along the outer surface of the body of the turbine bucket, and the threaded aperture extending into the rotor.

20. The turbo-machine of claim 18, wherein the annularly open threaded opening of the turbine bucket angularly extends along the outer surface of the body.

* * * * *